US007357171B2

(12) United States Patent
Miller

(10) Patent No.: US 7,357,171 B2
(45) Date of Patent: Apr. 15, 2008

(54) LOW-CLEARANCE SHUTTER SLAT

(75) Inventor: James V. Miller, Glen Ellyn, IL (US)

(73) Assignee: QMI Security Solutions, Itasca, IL (US)

( * ) Notice: Subject to any disclaimer, the term of this patent is extended or adjusted under 35 U.S.C. 154(b) by 31 days.

(21) Appl. No.: 10/802,385

(22) Filed: Mar. 17, 2004

(65) Prior Publication Data

US 2005/0205222 A1 Sep. 22, 2005

(51) Int. Cl.
*E06B 3/06* (2006.01)

(52) U.S. Cl. ..... 160/235; 160/133

(58) Field of Classification Search ..... 160/235, 160/236, 133, 210, 183
See application file for complete search history.

(56) References Cited

U.S. PATENT DOCUMENTS

| | | | |
|---|---|---|---|
| 638,314 | A | 12/1899 | Blades |
| 845,526 | A | 2/1907 | Collins |
| 876,593 | A | 1/1908 | Rush |
| 1,014,315 | A | 1/1912 | McCloud |
| 1,352,656 | A | 9/1920 | Cahill |
| 1,579,839 | A | 4/1926 | Raper |
| 1,776,119 | A | 9/1930 | Johnson |
| 1,892,570 | A | 12/1932 | Ginder |
| 1,918,415 | A | 7/1933 | Miller |
| 2,350,287 | A | 5/1944 | Michelman |
| 2,545,400 | A | 3/1951 | White |
| 2,812,813 | A | 11/1957 | Zarnowski |
| 2,858,883 | A | 11/1958 | Rapin |
| 3,292,685 | A | 12/1966 | Clark |
| 3,431,964 | A | 3/1969 | Rogers |
| 3,489,200 | A | 1/1970 | Recchione |
| 3,670,797 | A | 6/1972 | Sassano |
| 4,037,639 | A | 7/1977 | Jones |
| 4,294,302 | A | 10/1981 | Ricke, Sr. |
| 4,332,287 | A | 6/1982 | Stolpe |
| 4,343,340 | A | 8/1982 | Paule |
| 4,345,635 | A | 8/1982 | Solomon |
| 4,379,479 | A | 4/1983 | Whiting |
| 4,386,645 | A | 6/1983 | Dever et al. |
| 4,519,434 | A | 5/1985 | Forquer |
| 4,611,848 | A | 9/1986 | Romano |
| 4,628,982 | A | 12/1986 | Labelle |
| 4,690,193 | A | 9/1987 | Morrison et al. |
| 4,718,472 | A | 1/1988 | Hormann |
| 4,723,588 | A | 2/1988 | Ruppel |
| 4,738,296 | A | 4/1988 | Hatch |
| 4,795,206 | A | 1/1989 | Adams |

(Continued)

OTHER PUBLICATIONS

Lakal Rolladensysteme, Lakel Profil AHS 75 brochure, 4 pages—undated prior art.

(Continued)

*Primary Examiner*—Blair M. Johnson
(74) *Attorney, Agent, or Firm*—Ice Miller LLP

(57) ABSTRACT

A rolling shutter and a slat for use in a rolling shutter are provided. The slat comprises an engaging track located at a first horizontal edge and a receptacle track located at a second horizontal edge. Illustratively, the engaging track has a hook-shaped profile and is disposed at an acute angle, and the receptacle track comprises a lip and a guard defining a space adapted to receive therein an engaging track of an adjacent slat.

2 Claims, 5 Drawing Sheets

U.S. PATENT DOCUMENTS

| | | | | |
|---|---|---|---|---|
| 4,807,687 | A | | 2/1989 | Finch et al. |
| 4,929,862 | A | | 5/1990 | Hamilton et al. |
| 4,930,563 | A | | 6/1990 | Finch et al. |
| 5,040,843 | A | * | 8/1991 | Russell et al. ..... 296/98 |
| 5,070,925 | A | | 12/1991 | Paule |
| 5,154,468 | A | | 10/1992 | Teigen et al. |
| 5,165,746 | A | | 11/1992 | Teigen |
| 5,204,147 | A | | 4/1993 | Schneider |
| 5,209,281 | A | | 5/1993 | Kraeutler |
| 5,253,694 | A | | 10/1993 | Bernardo |
| 5,265,663 | A | | 11/1993 | Munekata et al. |
| 5,343,924 | A | | 9/1994 | Hoffman |
| 5,365,990 | A | | 11/1994 | Ueda |
| 5,372,175 | A | | 12/1994 | Calhoun et al. |
| 5,377,738 | A | | 1/1995 | Cooper |
| 5,426,893 | A | | 6/1995 | Hoffman |
| 5,469,905 | A | | 11/1995 | McKinney et al. |
| 5,482,104 | A | | 1/1996 | Lichy |
| 5,575,322 | A | | 11/1996 | Miller |
| 5,586,592 | A | | 12/1996 | McGregor |
| 5,601,130 | A | | 2/1997 | Werner et al. |
| 5,611,383 | A | | 3/1997 | Hoffman |
| 5,613,539 | A | | 3/1997 | Kraler |
| 5,657,805 | A | | 8/1997 | Magro |
| 5,682,937 | A | | 11/1997 | Decrane et al. |
| 5,839,493 | A | | 11/1998 | Quasius |
| 5,850,862 | A | | 12/1998 | Miller |
| 5,996,669 | A | | 12/1999 | Miller |
| 6,085,822 | A | | 7/2000 | Miller |
| 6,095,225 | A | | 8/2000 | Miller |
| 6,422,289 | B1 | | 7/2002 | Miller |
| 6,631,749 | B1 | | 10/2003 | Zabata |

OTHER PUBLICATIONS

SIRO Safety Roller Blind brochure 4 pages—prior art.

Sweet's General Building & Renovation 1993 Catalog File, Rollaway Insulating Security Shutters, Roll-A-Way, #B500, 8 pages.

Sweet's General Building & Renovation 1993 Catalog File, QMI Roll Shutter Supply, "BuyLine 6925" 4 pages.

Sweet's General Building & Renovation 1993 Catalog File, Solaroll Shade & Shutter Corporation, Catalog 561, #B505, 44 pages.

Sweet's General Building & Renovation 1993 Catalog File, Rolladen Rollshutters, Rolladen Inc., #B499, 8 pages.

Sweet's General Building & Renovation 1993 Catalog File, Hurst Shutters Accordion Shutters/Removable Shutters, Hurst Awning Company, Inc. #B492, 8 pages.

Sweet's General Building & Renovation 1993 Catalog File, Environblind Exterior Rolling Shutters, Environmental Seal and Security Co., Inc. #B489, 4 pages.

* cited by examiner

LOW-CLEARANCE SHUTTER SLAT

FIELD OF THE INVENTION

The present invention relates to shutters and in particular to shutters of the roller type having improved resistance to storms and break-ins. It furthermore relates to a shutter having improved retraction capability.

DESCRIPTION OF THE RELATED ART

Conventional roller shutters are designed to provide security from break-ins or protection from storms. Because such protection and security may not always be necessary or desired, such as during the day when a retail store is open for business, or during fine weather when a homeowner wishes to open windows or enjoy an ocean view, roller shutters are designed to be retractable into a casing in which they are stored. To facilitate compact storage, rigid shutter slats designed to resist hurricane winds and burglars must be capable of conforming to a roll.

One conventional shutter slat is made to conform to a roll by providing a loose articulation between slats. Slats are slidably engaged at the upper edge of one slat and the lower edge of another slat. The upper edge comprises a vertical projection terminating in a hook-shaped profile. The lower edge comprises a first portion and a second portion, which define a vertical pocket. The hook-shaped profile of the upper edge allows the upper edge to engage the first portion of the lower edge, also having a hook-shaped profile. The upper edge is prevented from undesirably disengaging by the second portion of the lower edge, which comprises a guard extending downward to slightly below the hook-shaped profile of the lower edge, defining a horizontal aperture between the first and second portions of the lower edge. The vertical pocket defined by the first and second portions of the lower edge is similar in depth to the height of the vertical projection of the upper edge. This shutter configuration's flexibility arises from the pivoting of the vertical portion of the upper edge within the horizontal aperture.

One result of this configuration is that the upper edge has significant vertical clearance within the vertical pocket. For a shutter according to this configuration, a clearance of one-quarter inch per slat would be expected. A shutter having 48 slats would then have a total clearance of twelve inches. To raise such a shutter, a user must lift the bottom slat either by hand or mechanically to correct for the full amount of clearance before the shutter will begin to retract. In the case of a conventional shutter having 48 slats with one-quarter inch of clearance per slat, a user would have to lift approximately 150 pounds by twelve inches in order to engage the shutter's retraction mechanism.

A further result of this configuration is that the loosely articulated slats are known to be noisy. The slats rattle against each other during extension and retraction. In addition, when the roller shutter is deployed, the normal forces of the wind are sufficient to cause the slats to rattle audibly.

A second conventional solution to the problem of compact storage includes integration of a boss concentric with the articulation between adjoining slats, as described in U.S. Pat. No. 6,095,225 to Miller, titled "Shutter Slat with Integrated Boss." Slats in this configuration are also slidably engaged at the upper edge of one slat and the lower edge of another slat. The upper edge comprises a short vertical projection terminating in a c-shaped screw boss, and the lower edge comprises a c-shaped channel having a diameter sufficient to accommodate the upper edge. This shutter configuration's flexibility arises from the cooperation of the rounded internal surface of the c-shaped channel and the rounded external surface of the c-shaped screw boss. The diameter of the upper edge is smaller than the diameter of the c-shaped channel, but greater than the width of the aperture defined by the c-shaped channel, preventing the upper edge from simply falling out of the c-shaped channel provided by the lower edge.

One result of this configuration is that if the exposed portion of the c-shaped channel of the lower edge gives way upon exertion of pressure on the articulation, the slats may separate undesirably. Because the retention of the upper edge by the c-shaped channel is based on a relatively small difference in size, damage to either edge may result in a breach of the curtain. For example, if a putative intruder uses a sledgehammer to dent or bend a shutter, the c-shaped channel may be forced open. Even if the channel is bent only slightly, once a gap is formed between an upper edge and a lower edge, the two slats may be pried apart with undesirably slight effort.

A further result of this configuration is that in use of a concentric retention screw, the normal collection of dirt and grime around the screw may impede the flexibility of the articulation between slats.

OBJECTS OF THE INVENTION

It is an object of the present invention to improve the ease and smoothness of extension and retraction of the roller shutter.

It is another object of the invention to provide a stable, secure connection between slats of the roller shutter and between the roller shutter and the guides, thereby improving the security and protection provided by the roller shutter.

It is a further object of the invention to reduce the noise associated with extension and retraction of the roller shutter, as well as the noise associated with a deployed roller shutter.

SUMMARY OF THE INVENTION

According to the present invention, smooth extension and retraction of the roller shutter may be achieved with significantly less effort than required by prior art devices by minimizing the clearance between the engaging track of one shutter slat and the receptacle track of the adjacent shutter slat. There is thus provided a shutter for a building aperture comprising a plurality of shutter slats each having a first face and a second face, and a first end and a second end, and an upper and a lower horizontal edge, which are articulated to form a roller shutter having a first face and a second face, and a first end and a second end. Each shutter slat further has an engaging track and a receptacle track, which run along opposing horizontal edges of each shutter slat. The shutter further comprises two guides, with one guide locatable at either end of the roller shutter.

Advantageously, clearance between engaging and receptacle tracks may be decreased by the alteration of the angle of the engaging track relative to the vertical axis of the shutter curtain. The present invention provides for the engaging track to be disposed at an acute angle to the vertical axis of an upright shutter slat. In contrast to prior art shutter slats, the angled engaging track of the present invention allows shutter slats to pivot freely while remaining securely disposed within the receptacle track.

According to another aspect of the invention, the stability of the connection between engaging track and receptacle track is further improved by providing a guard along the receptacle track. Use of the guard provides protection for the lip and engaging track against damage inflicted on the first face of the roller shutter, such as by a storm or an intruder. Additionally, the security of the roller shutter within the guides is improved by the provision of a receptacle for a retention screw above the main pocket of the receptacle track rather than concentrically with the articulation. The retention screw, which is used to slidably mount each shutter slat on the first and second guides, is therefore shielded from external forces, including attempts to compromise the integrity of an articulation by forcing two shutter slats apart. The combination of the receptacle and the guard as provided in the present invention improves stability and security over the use of a concentric receptacle by increasing the force needed to separate an articulation between slats or separate the roller shutter from a guide.

In yet another aspect of the present invention, the complementary curved profiles of the engaging and receptacle tracks combined with the reduced clearance between shutter slats will minimize the noise associated with operation and use of the roller shutter. If, as the engaging track pivots within the receptacle track, the convex interior of the engaging track contacts the concave interior of the receptacle track, the former will slide against the latter. In contrast to a loosely articulated shutter slat, the engaging track of the present invention has no flat (vertical) surfaces to rattle or clank between the first and second portions of the receptacle track. Furthermore, by configuring the receptacle track to receive a retention screw that is not concentric with the engaging track, the ordinary collection of dirt and grime around the retention screw will not cause squeaking between slats or impede the flexibility of the articulation between slats.

BRIEF DESCRIPTION OF THE DRAWINGS

Embodiments of the invention will now be explained in further detail by way of example only with reference to the accompanying figures, in which.

DETAILED DESCRIPTION

Figure 5:
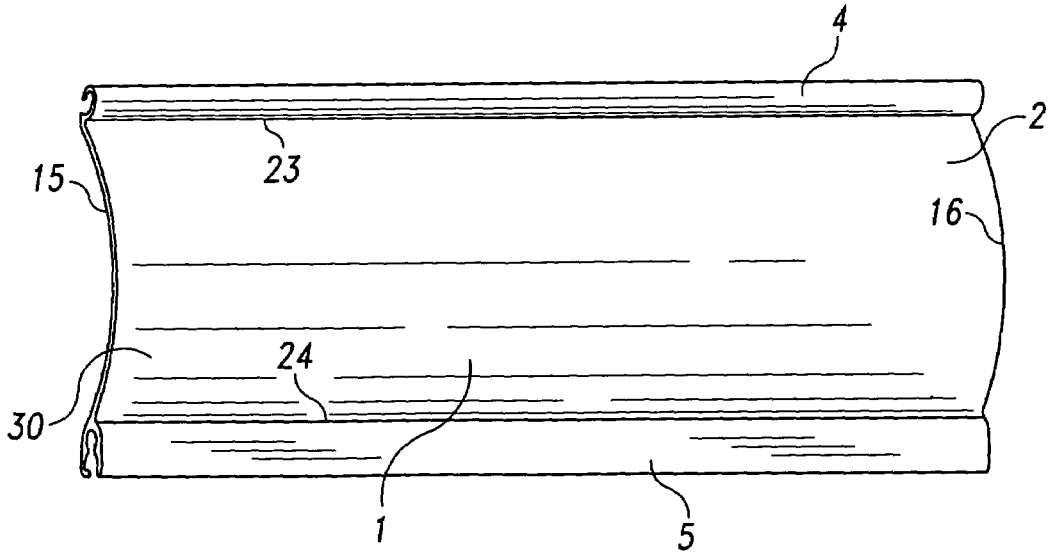
FIG. 5 is an elevation of a shutter slat according to the present invention.

FIG. 5 depicts an elevation of a low-clearance shutter slat according to the present invention. Shutter slat 1 is an elongated body of single-ply extruded aluminum having a first end 15 and a second end 16, a body portion 30 bounded by an upper edge 23 and a lower edge 24, and an engaging track 4 and a receptacle track 5.

Figure 1:
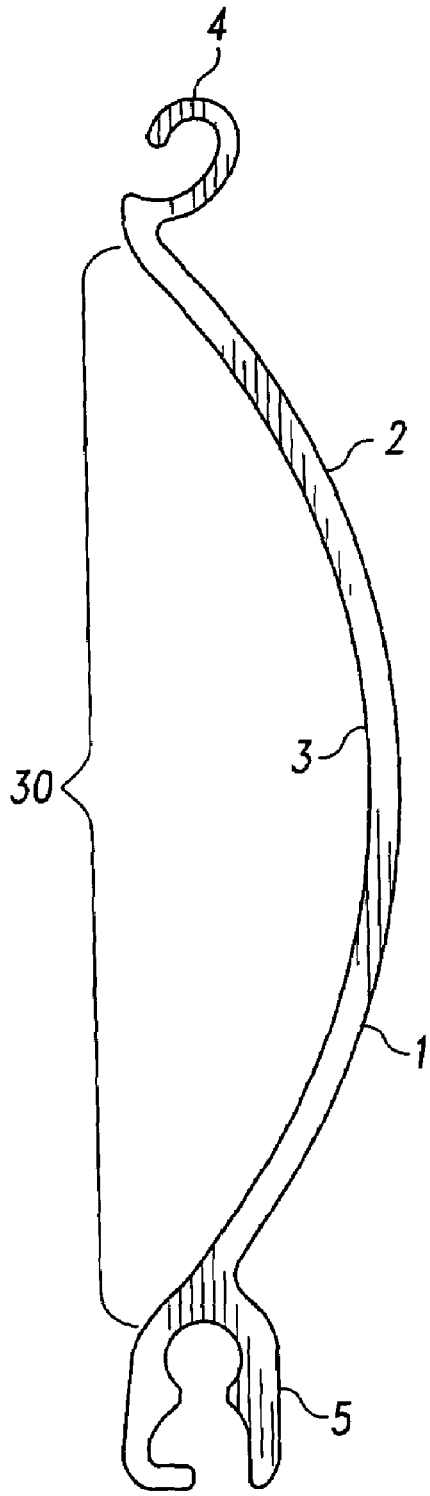
FIG. 1 is a side view of a low-clearance shutter slat according to the present invention.

FIG. 1 is a side view of a low-clearance shutter slat according to the present invention. FIG. 1 depicts a first side 2 of shutter slat 1 and a second side 3, the body portion 30, and the profile of engaging track 4 and receptacle track 5.

As shown, for example, in FIG. 1, each slat 1 has an overall width 160 extending from the upper end 162 of the engaging track 4 to the lower end 164 of the receptacle track 5. In one illustrated embodiment, the overall width 160 is 2.738 inches. However, those skilled in the art will recognize that the overall width 160 of the slat 1 is not critical so long as the slat 1 is configured to roll into shutter casing 17.

Figure 8:
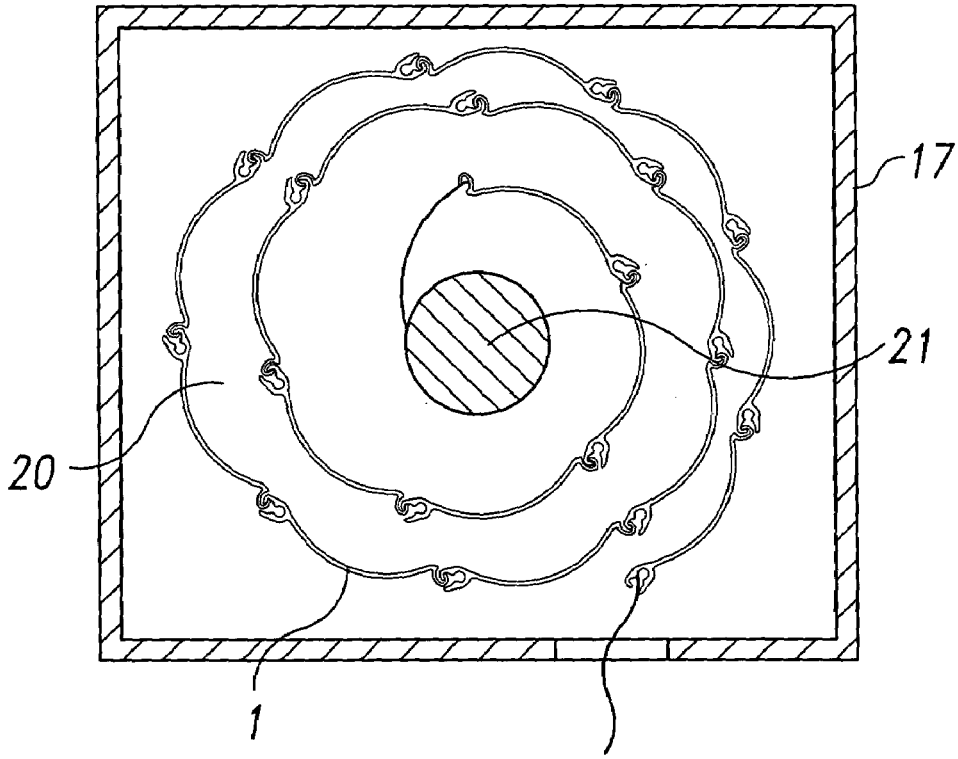
FIG. 8 is a vertical section view of a roller shutter according to the present invention, showing a plurality of shutter slats rolled up within a shutter casing.
Figure 1:
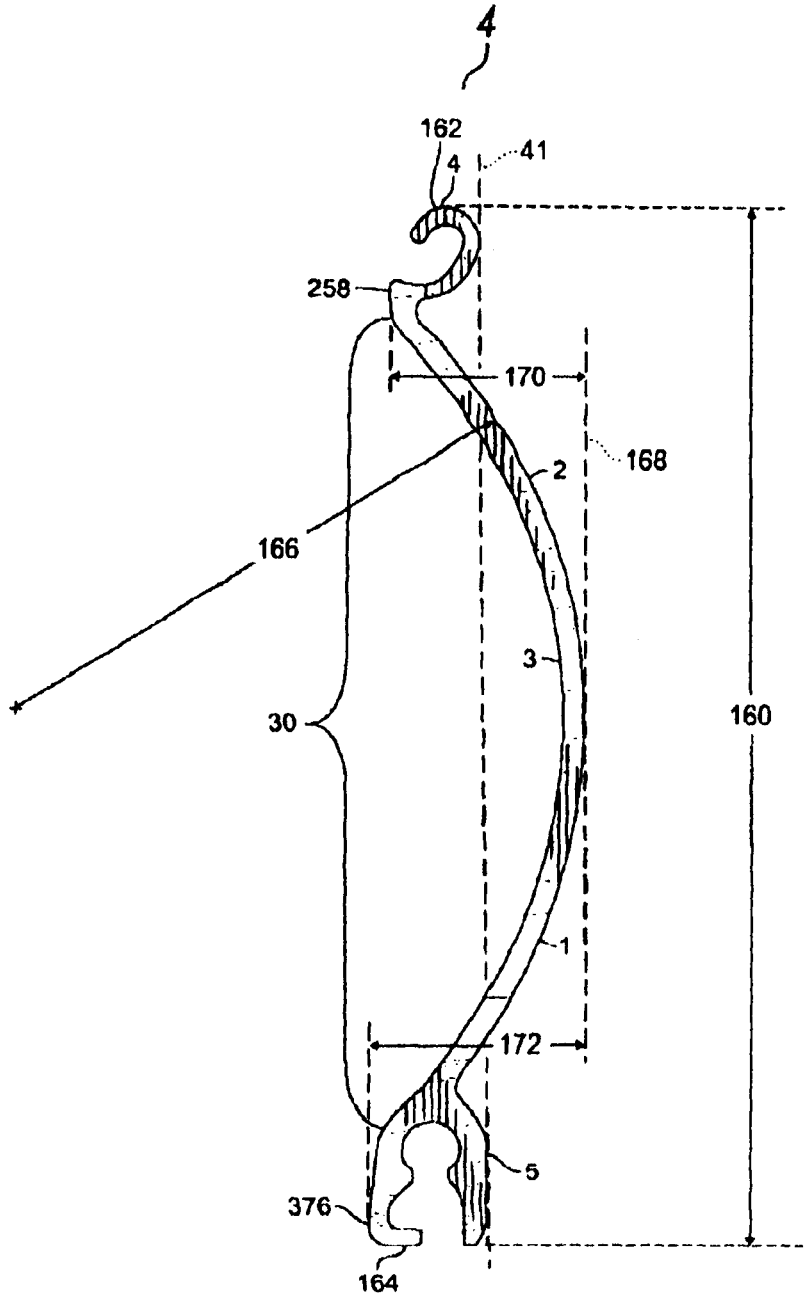
Figure 2:
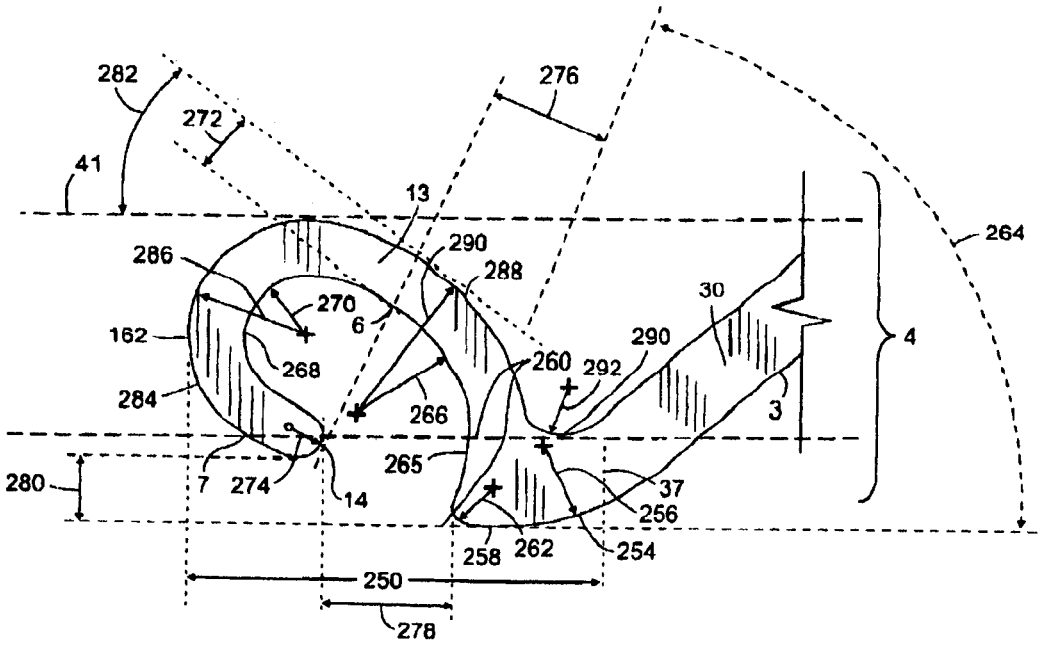
Figure 3:
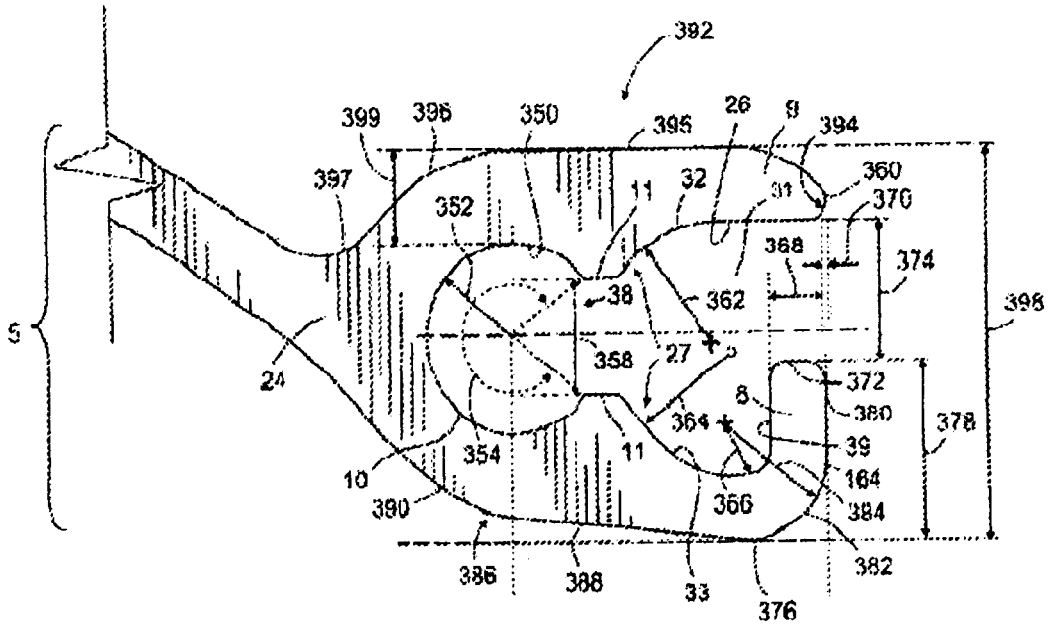

As shown, for example, in FIG. 1, second side 3 of body portion 30 has a concave cross-section and first side 2 has a convex cross-section when sectioned vertically at any location along the length of the slat 1. The first side wall 2 of body portion 30 of slat 1 is formed with a radius of curvature 166. The second side 3 of the body portion 30 of slat 1 is formed with a similar radius of curvature measured from a focus displaced along a line perpendicular to the tangent 168 to the first convex surface 2 parallel to the axis 41 of the body portion 30 by a displacement equal to the displacement between the first and second sides 2, 3, respectively. In one specific embodiment, the radius of curvature 166 of the first wall of the body portion 30 of slat 1 is approximately 1.551 inches. The overall width 160 of the slat 1 and the radius of curvature 166 of the body portion 30, cooperate to allow a roller shutter 20 formed from slats 1 to roll when retracted around a spindle 21 (FIG. 8). The radius of curvature 166 of the body portion 30 and overall width 160 of slat 1 are selected to facilitate retraction and winding of the curtain 20 formed from slats 1 around the spindle 21 and to provide strength to the curtain 20.

Figure 2:
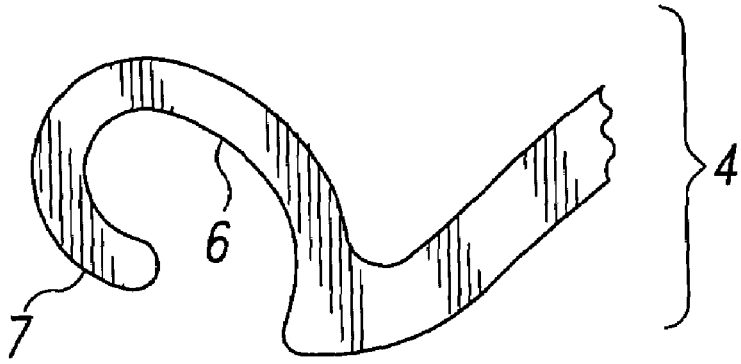
FIG. 2 is a detailed side view of an engaging track according to the present invention.

A detail of engaging track 4 is shown in FIG. 2. Engaging track 4, located at upper edge 23 of shutter slat 1, comprises a track running the length of shutter slat 1 having a hook-shaped cross-sectional profile taken along a vertical plane perpendicular to the longitudinal axis of the slat 1. Engaging track 4 further comprises an inner surface 6 and an outer surface 7. Engaging track 4 is disposed at an acute angle to the vertical axis of an upright shutter slat. It is to be understood that engaging track 4 could, in the alternate, be located at lower edge 24.

The engaging track 4 has an overall width 250 extending from the connection point 37 with the body portion 30 to the upper end 162 of the engaging track 4 of the slat 1. In the illustrated embodiment, the overall width 250 of engaging track 4 is 0.294 inches. Adjacent the connection point 37 and upwardly therefrom along the interior surface of the engaging track 4 a transition surface 254 having a radius of curvature 256 is formed to transition the inside wall of the slat 1 from the concave curvature of the second wall 3 of the body portion 30 to a wall 258 that is substantially parallel to the tangent 168 to the first wall 2 of the body portion 30 that is parallel to the vertical axis 41 of the slat 1.

As shown, for example, in FIG. 1, the wall 258 of the engaging track 4 is displaced inwardly from the tangent 168 by a displacement 170. In the illustrated embodiment of slat 1, displacement 170 is approximately 0.511 inches. As used herein, up, upward or other similar terms refers to toward the top, down, downward or other similar terms refers to toward the bottom, out, outward or other similar terms refers to toward the right and in, inward or other similar terms refers to toward the left in FIG. 1, on the understanding that the convex surface of each slat 1 faces toward the outside of a structure and the engaging end 4 of each slat 1 hooks to the receptacle end 5 of a slat 1 thereabove to form a roller shutter 20. Usage of such terms however should be viewed as relative usage as it is within the scope of the disclosure for the slats 1 forming the roller shutter 20 to be oriented in a different manner.

A radiused wall 260 is formed and extends between the wall 258 and the inside wall 6 of the hook-shaped member 13. The radiused wall 260 facilitates the elimination of binding between the engaging track 4 of a first slat 1*a* and the receptacle track 5 of a second slat 1*b* during articulation of the slats 1*a* and 1*b*, such as for instance during retraction or extension of the roller shutter 20 fabricated therefrom. In the illustrated embodiment, the radiused wall 260 has a radius of curvature 262 of 0.019 inches. Thus, the tangent to the lower wall 265 of the inner surface 6 of hook-shaped member 13 forms an angle 264 with respect to the wall 258 (and consequently with respect to the axis 41 and the tangent 168 to the first wall 2 of the body portion 30).

The lower wall 265 may be a compound curve having varying radii of curvature along the extent of the lower wall 265. During articulation of the slats 1 forming the roller shutter 20, especially during lifting of the roller shutter 20 to initiate retraction, the outer surface of lip 8 of retention track 5 either rides against or is constrained by lower wall 265. In one illustrated embodiment, the radius of curvature 266 of the lower wall 265 is approximately 0.127 inches (i.e. 0.040 inches (the thickness 272 of hook 13) less than the radius of curvature of the opposite portion of the outer surface 7).

The upper wall 268 of inside surface 6 of hook portion 13 has a radius of curvature 270 and extends between and couples the lower wall 265 to the tip 14 of the hook portion 13. In one illustrated embodiment, the upper wall 268 has a radius of curvature of approximately 0.049 inches. Thus, the radius of curvature of the inside surface 6 of hook portion 13, gets smaller adjacent the tip 14 since the radius of curvature 266 of lower wall 265 is significantly larger than the radius of curvature of upper wall 268 which is adjacent the tip 14.

The tip 14 has a radius of curvature 274 to facilitate articulation of one slat relative to another when the engaging track of a first slat is received in the receptacle track 5 of the other to form a roller shutter 20. In one illustrated embodiment, wherein the thickness 272 of the hook portion 13 is approximately 0.04 inches, the radius of curvature 274 of the tip is approximately 0.02 inches. The tip extends between and couples the outer surface 7 and inner wall of the hook portion 13. As, shown, for example, in FIG. 2, the tip 14 is spaced apart from the edge of the lower wall 265 of the inner surface 6 of the hook portion by a displacement 276. In the illustrated embodiment, the displacement 276 is approximately 0.103 inches. Such displacement 276, because the engaging track 4 extends at an acute angle 282 relative to the vertical axis 41, has a vertical component 278 (i.e. the component of the displacement as measured along axis 41 of the slat 1) and a horizontal component 280 (i.e. the component of the displacement as measured horizontally). In the illustrated embodiment, the horizontal component 280 of the displacement 276 is approximately 0.051 inches. Thus the tip 14 is displaced outwardly from the edge of the inner surface 6 adjacent the body portion 30. In the illustrated embodiment, the vertical component 278 of the displacement between the tip 14 and the inside edge of the lower wall 265 of the inner wall is approximately 0.093 inches. Thus, the tip 14 is displaced upwardly from the edge of the inner surface 6 adjacent the body portion 30.

Considering that the lip 8 of the illustrated receptacle track 5 is 0.050 inches thick and the vertical component 278 of the displacement between the tip and the edge of the inner surface 6 is 0.093 inches, when the illustrated engaging track 4 is received in a receptacle track 5 of an adjacent slat, the lower slat can only move vertically upwardly relative to the upper slat by approximately 0.043 inches.

Tip 14 extends between and couples the distal end of the upper wall 268 of the inner surface 6 of hook portion to the distal end of the upper wall 284 of the outer surface 7 of the hook portion 13. The upper wall 284 of the outer surface 7 of the hook portion has a radius of curvature 286 which in conjunction with the radius of curvature 270 of the upper wall 268 of the inner surface 6 causes the hook portion to have a substantially uniform thickness 272 from the tip 14 to adjacent the body portion 30. In the illustrated embodiment, the radius of curvature 286 is approximately 0.090 inches.

The proximate end of the upper wall 284 is coupled to the lower wall 288 of the outer surface 7 of the hook portion 13, as shown, for example, in FIG. 2. The lower wall 288 of the outer surface 7 of the hook portion has a radius of curvature 290 which in conjunction with the radius of curvature 266 of the lower wall 265 of the inner surface 6 causes the hook portion 13 to have a substantially uniform thickness 272 from the tip 14 to adjacent the body portion 30. In the illustrated embodiment, the radius of curvature 290 is approximately 0.167 inches. The proximal end of the lower wall 288 of the outer surface 7 of the hook portion smoothly transitions into the edge of the body portion via a transition wall 291 having a radius of curvature 294. In the illustrated embodiment, the radius of curvature 292 of the transition wall 291 is approximately 0.031 inches.

Figure 3:
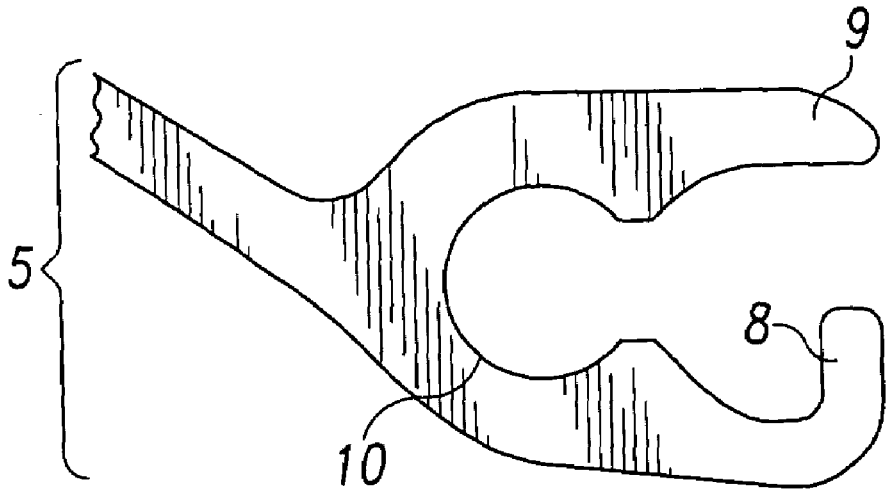
FIG. 3 is a detailed side view of a receptacle track according to the present invention.
Figure 4:
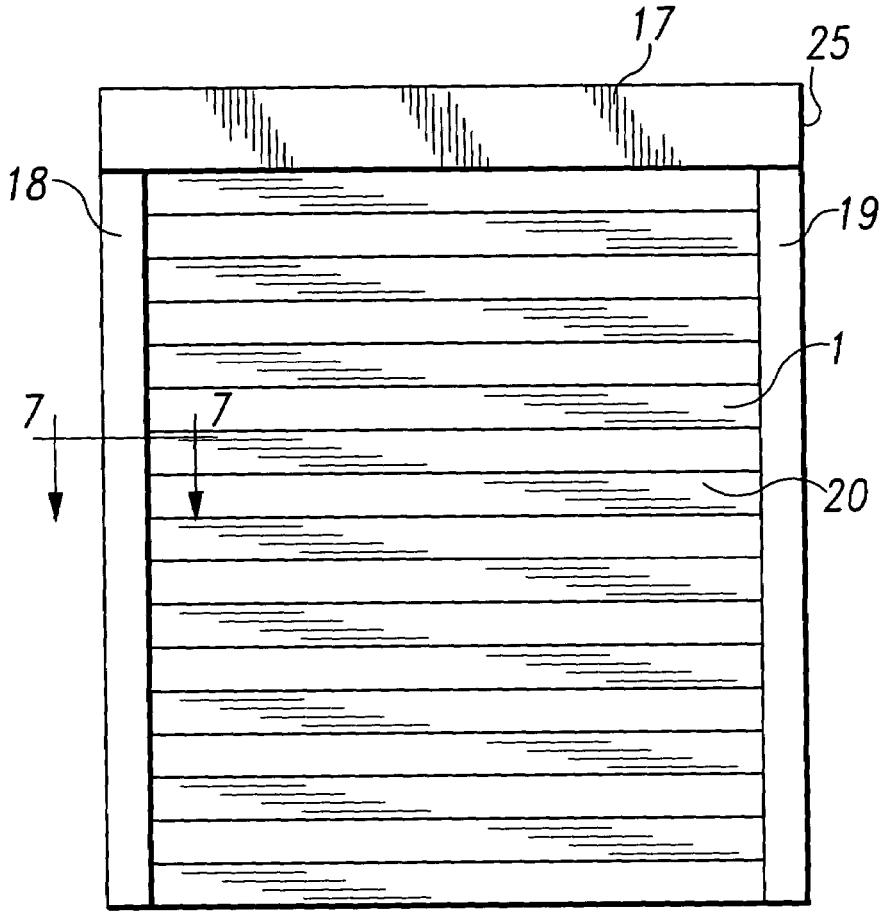
FIG. 4 is an elevation of a window aperture including a shutter according to the present invention.

FIG. 3 depicts a detail of receptacle track 5, located at lower edge 24. Receptacle track 5 comprises a track running the length of shutter slat 1. Receptacle track 5 further comprises a lip 8, a guard 9, and a receptacle 10. When the slat 1 is in a vertical position, receptacle 10 is located above the aperture 31 defined by lip 8 and guard 9. Receptacle 10 is adapted to receive retention screw 22 (not shown). It is to be understood that receptacle track 5 could, in the alternate, be located at upper edge 23 but in any case the receptacle 10 would be located between the body portion of the shutter slat 1 and the aperture defined by lip 8 and guard 9.

As shown, for example, in FIG. 3, the aperture or articulation space 31 is the space within which an engaging track 4 of another slat is received to form rolling shutter 20. As shown, for example, in FIG. 3, the aperture 31 is defined by a plurality of surfaces defining a discontiguous articulating surface 27, a straight articulating surface 26 being the interior surface of guard 9 (which may be considered a portion of first articulating surface 32) and an interior articulating surface 39 of lip 8. Discontiguous articulating surface 27 comprises a first articulating surface 32 spaced apart at adjacent ends and separated by a gap 38 from a second articulating surface 33. The gap 38 is the space between shoulders 11 defined by the junction of the receptacle 10 and the first and second articulating surfaces 32, 33. The shoulders 11 are spaced apart by a displacement 358. In the illustrated embodiment, the receptacle 10 is configured for receipt of the threads of a screw 22 (FIG. 7) therein to attach a guide to the slat 1. Thus, receptacle has a partial circular profile defined by a curved wall 350 extending along an arc 354 having a radius of curvature 352. In order to retain the threaded shaft of the screw 22 in the receptacle 10, the curved wall 350 must extend more than 180 degrees along the arc 354. Preferably, receptacle 10 opens into and is in communication through gap 38 with articulation space 31 facilitating formation of the slat 1 utilizing extrusion, and thus, curved wall 350 extends less than 360 degrees about the arc 354.

In one illustrated embodiment, The displacement 358 between shoulders 11 is approximately 0.089 inches. In this same embodiment, the radius of curvature 352 of the curved wall 350 defining receptacle 10 is approximately 0.074 inches providing a diameter of receptacle of 0.148 inches. In this same embodiment, the curved wall 350 defining receptacle 10 extends approximately 297.96 degrees (360−2*arctan ((0.5*0.89)/0.74)=360−2*31.02=360−62.04 degrees) along arc 354. It is within the scope of the disclosure for slats 1 to be of different sizes than those illustrated herein and for the various dimensions to be proportional within a range to those of the illustrated embodiment of slat 1.

As shown, for example, in FIG. 3, straight articulation surface 26 is a substantially planar surface extending inwardly from a tip 360 of the guard 9 and forming a junction with the first articulation surface 32. The first articulation surface 32 is a concave curved surface which illustratively has a radius of curvature 362. First articulation surface 32 terminates at an upper end at a junction formed by shoulder 11 with the curved wall or surface of receptacle 10. In one illustrated embodiment, the radius of curvature of first articulation surface 32 is approximately 0.110 inches. Second articulation surface 33 is a concave curved surface extending from an upper end (adjacent to the upper end of first articulation surface 32 and separated therefrom gap 38) defined by shoulder 11 at the junction with the curved wall 350 to a lower end at the junction with the interior articulation surface 39 of the lip 8. Illustratively, second articulating surface 33 has a decreasing radius of curvature as it extends from the upper end toward the lower end. Second articulating surface 33 has a radius of curvature 364 adjacent the upper end and a radius of curvature 366 adjacent the lower end. In the illustrated embodiment, radius of curvature 364 is approximately 0.111 inches and radius of curvature 366 is approximately 0.24 inches.

The lip 8 extends outwardly (and in the illustrated embodiment, slightly upwardly) from the lower end of second articulating surface 33 toward the straight articulating surface 26 of guard 9. In the illustrated embodiment, lip 8 has a thickness 368 and extends upwardly at an angle 370 from the lower end 164 of the slat 1. In the illustrated embodiment, thickness 368 is approximately 0.050 inches and angle 370 is approximately five degrees. The lip 8 terminates at a tip 372 spaced apart by a displacement 374 from the straight articulating surface 26 of the guard 9. In the illustrated embodiment displacement 374 is approximately 0.109 inches. Tip 372 is displaced from the innermost surface 376 of the receptacle track 5 by a displacement 378. In the illustrated embodiment, displacement 378 is approximately 0.0140 inches. As shown, for example, in FIG. 1, the innermost surface 376 is displaced inwardly from the tangent 168 to the first side 2 of body portion 30 by a displacement 172. In the illustrated embodiment, displacement 172 is approximately 0.533 inches and is greater than the displacement 170 between the wall 258 of the engaging track 4 and the tangent 168.

As shown in FIG. 3, the tip 372 of lip 8 and the straight articulating surface 26 of the guard 9 define an opening 379 communicating with the articulation space 31. This opening 379 receives the hook portion 13 of an engaging track 4 of another slat therein when a roller shutter 20 is formed from slats 1 and facilitate articulation of the slats relative to each other. As shown, for example, in FIG. 3, tip 372 may include radiused corners at the junctions with the articulating surface 26 and the lower surface 380 of the lip 8.

In the illustrated embodiment, the lower surface 380 of the lip 8 extends between and couples the tip 372 to a transition wall 382. Illustratively, transition wall 382 extends between the lower surface 380 and the innermost surface 376 of the receptacle track 5. Transition wall 382 is a convex wall having a radius of curvature 384 to reduce interference with the articulation of slats 1 forming a roller shutter 20 relative to each other. In the illustrated embodiment, radius of curvature 384 of approximately 0.074 inches.

The inner surface 386 of the receptacle track 5 includes a substantially planar wall 388 extending upwardly and inwardly from the inner most surface 376 to a compound curved wall 390. Compound curved wall 390 extends from the wall 388 to the lower edge 24 of body portion 30 of slat 1.

As shown, for example, in FIG. 3, the tip 360 of the guard 9 extends between and couples outside wall 392 of the receptacle track 5 to the straight articulating surface 26 of guard 9. Adjacent the junction with straight articulating surface 26, tip 360 may exhibit a radius of curvature 394 to allow some outward articulation of one slat of a rolling shutter 20 relative to slat 1. In the illustrated embodiment, radius of curvature 394 is approximately 0.016 inches. The outside wall 392 of receptacle track illustratively includes a planar portion 395 substantially parallel to the vertical axis 41 of the slat 1, a convex transition portion 396 and a concave transition portion 397. The concave transition portion 397 of outer wall 392 couples the outer wall 392 to the outer surface 6 of the body portion. The convex portion 396 and concave portion 397 of outer wall 392 help to reduce material required for production of slat 1 and thus facilitate extrusion of the slat 1.

The planar portion 395 of the outside wall 392 is displaced from the innermost surface 376 of the receptacle track 5 by a displacement 398. In the illustrated embodiment, displacement 398 is approximately 0.035 inches. The planar portion 395 of the outside wall 392 is spaced apart outwardly from the curved wall 350 of the receptacle by a displacement 399. Displacement 399 is selected to reduce deformation of engaging track 5 when a screw 22 is received in receptacle 10. In the illustrated embodiment displacement 399 is approximately 0.070 inches.

FIG. 8 shows an elevation of a plurality of shutter slats 1 according to the present invention, articulated into a roller shutter 20 which may be installed on a building aperture 25 such as a window or door. Details of building aperture 25 are not illustrated for the sake of clarity. Building aperture 25 is further equipped with a shutter casing 17 and a pair of guides 18 and 19, located on opposite lateral edges of building aperture 25. Roller shutter 20 may be rolled up for storage within shutter casing 17.

Figure 6:
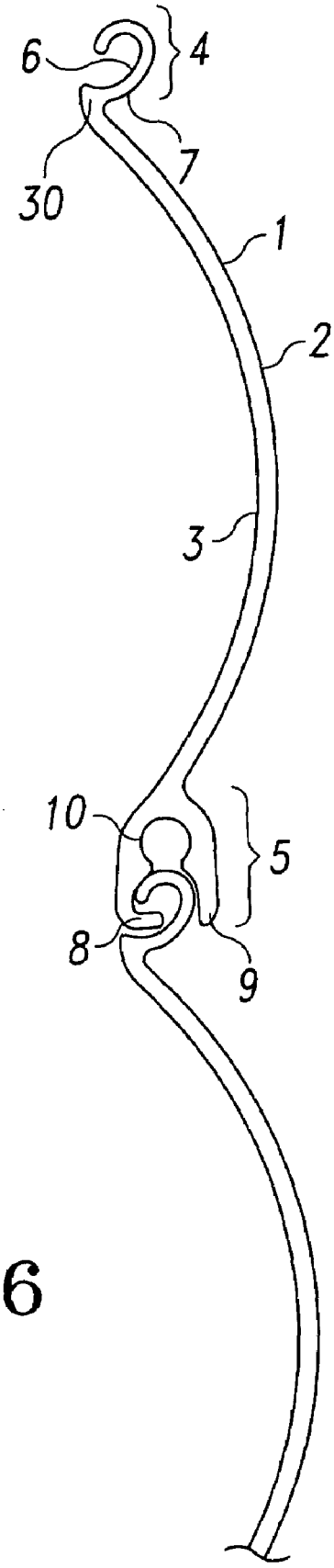
FIG. 6 is a side view of the cooperation of two shutter slats according to the present invention.

FIG. 6 is a side view of the articulation of two shutter slats 1 according to the present invention. Engaging track 4 is slidably engaged within receptacle track 5 of the adjacent shutter slat 1. Inner surface 6 rests against lip 8. Guard 9 shields the connection of engaging track 4 with lip 10, preventing engaging track 4 from undesirably disengaging from receptacle track 5. Guard 9 also protects the engaging track 4 and lip 10 from exposure to forces applied to the first side 2 of shutter slat 1. Because engaging track 4 does not bear directly upon guard 9, damage to first side 2 including to guard 9 is less likely to disengage the articulation between shutter slats 1 than in prior art shutters in which an exposed portion of a lower track was weight-bearing.

Figure 7:
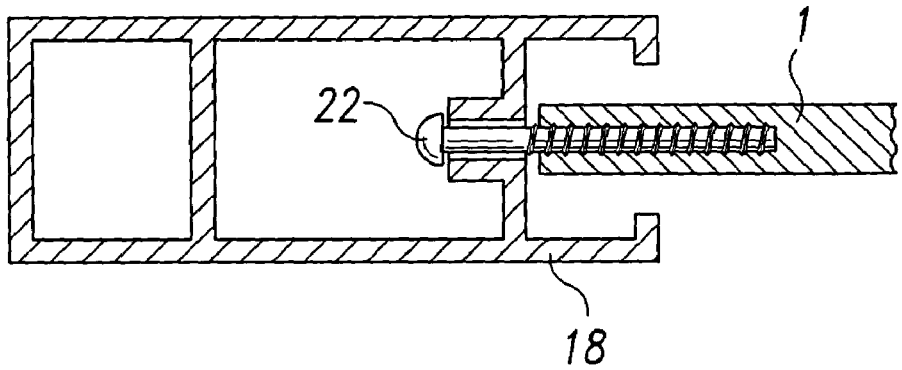
FIG. 7 is a partial horizontal sectional view according to the present invention.

FIG. 7 is a partial sectional view according to the present invention. A shutter slat 1 is shown in combination with a guard 18 and a retention screw 22. A retention screw 22 is preferably inserted in receptacle 11 (not shown) of shutter slat 1 for use with a guide 18, 19 (only guide 18 is shown). The head of the retention screw 22 protrudes from receptacle 11 and slides within a vertical guide 18, 19 provided at each end of the roller shutter 20. In this invention, the retention screw 22 does not restrict the rotation or pivoting of engaging track 4 within receptacle track 5. It is also preferred, for minimization of the rolled shutter, that the diameter of the head of the retention screw 22 is not larger than the external profile of the receptacle track 5.

In contrast to prior art systems that require significant clearance at the articulation in order to allow pivoting, the angled engaging track 4 of the present invention allows shutter slat 1 to pivot freely within receptacle track 5.

The resulting flexibility of the roller shutter 20 allows the roller shutter 20 to be rolled up at a favorably compact size into shutter casing 17.

Modifications in addition to those described above may be made to the structures and techniques described herein without departing from the spirit and scope of the invention. Accordingly, although specific embodiments have been described, these are examples only and are not limiting on the scope of the invention.

I claim:

1. A slat for use in a rolling shutter, comprising:

a body having a first edge, a second edge, a first side extending along a curve between the first edge and the second edge, and a second side extending along a curve between the first edge and the second edge;

an engaging track located at the first edge of the body, for receiving an engaging track of an adjacent slat through an aperture thereof wherein the engaging track extends from the first edge along an arc; and a receptacle track located at the second edge of the body, wherein the receptacle track includes a discontiguous articulation surface having a first concave articulation surface having an end adjacent the body and the end adjacent an aperture spaced a distance apart from a second concave articulation surface having an end adjacent the body and an end adjacent the aperture, a gap defining a space between the ends adjacent the body of the first and second articulation surfaces, a lip adjacent to the first articulation surface extending away from the end adjacent the aperture of the first articulation surface towards the end adjacent the aperture of the second articulation surface thereby defining the aperture therebetween, and a receptacle in the body defining a substantially circular surface in crossection extending continuously between the ends of the first and second articulation surfaces adjacent the body for receiving a retention device.

2. The slat of claim 1, wherein the substantially circular surface is configured to receive the shaft of a screw for mounting a guide to the slat.

* * * * *

UNITED STATES PATENT AND TRADEMARK OFFICE

CERTIFICATE OF CORRECTION

PATENT NO. : 7,357,171 B2
APPLICATION NO. : 10/802385
DATED : April 15, 2008
INVENTOR(S) : James V. Miller It is certified that error appears in the above-identified patent and that said Letters Patent is hereby corrected as shown below:

Delete title page and substitute therefore the attached title page consisting of the corrected illustrative figure.

Delete Drawing Sheets 1 of 5 and 2 of 5 and substitute therefore the attached Drawing Sheets 1 of 5 and 2 of 5.

Signed and Sealed this

Thirteenth Day of July, 2010

David J. Kappos

David J. Kappos
*Director of the United States Patent and Trademark Office*

(12) United States Patent
Miller

(10) Patent No.: US 7,357,171 B2
(45) Date of Patent: Apr. 15, 2008

(54) LOW-CLEARANCE SHUTTER SLAT

(75) Inventor: James V. Miller, Glen Ellyn, IL (US)

(73) Assignee: QMI Security Solutions, Itasca, IL (US)

( * ) Notice: Subject to any disclaimer, the term of this patent is extended or adjusted under 35 U.S.C. 154(b) by 31 days.

(21) Appl. No.: 10/802,385

(22) Filed: Mar. 17, 2004

(65) Prior Publication Data

US 2005/0205222 A1 Sep. 22, 2005

(51) Int. Cl.
*E06B 3/06* (2006.01)

(52) U.S. Cl. ..... 160/235; 160/133

(58) Field of Classification Search ..... 160/235, 160/236, 133, 210, 183
See application file for complete search history.

(56) References Cited

U.S. PATENT DOCUMENTS

| | | | |
|---|---|---|---|
| 638,314 | A | 12/1899 | Blades |
| 845,526 | A | 2/1907 | Collins |
| 876,593 | A | 1/1908 | Rush |
| 1,014,315 | A | 1/1912 | McCloud |
| 1,352,656 | A | 9/1920 | Cahill |
| 1,579,839 | A | 4/1926 | Raper |
| 1,776,119 | A | 9/1930 | Johnson |
| 1,892,570 | A | 12/1932 | Ginder |
| 1,918,415 | A | 7/1933 | Miller |
| 2,350,287 | A | 5/1944 | Michelman |
| 2,545,400 | A | 3/1951 | White |
| 2,812,813 | A | 11/1957 | Zarnowski |
| 2,858,883 | A | 11/1958 | Rapin |
| 3,292,685 | A | 12/1966 | Clark |
| 3,431,964 | A | 3/1969 | Rogers |
| 3,489,200 | A | 1/1970 | Recchione |
| 3,670,797 | A | 6/1972 | Sassano |
| 4,037,639 | A | 7/1977 | Jones |
| 4,294,302 | A | 10/1981 | Ricke, Sr. |
| 4,332,287 | A | 6/1982 | Stolpe |
| 4,343,340 | A | 8/1982 | Paule |
| 4,345,635 | A | 8/1982 | Solomon |
| 4,379,479 | A | 4/1983 | Whiting |
| 4,386,645 | A | 6/1983 | Dever et al. |
| 4,519,434 | A | 5/1985 | Forquer |
| 4,611,848 | A | 9/1986 | Romano |
| 4,628,982 | A | 12/1986 | Labelle |
| 4,690,193 | A | 9/1987 | Morrison et al. |
| 4,718,472 | A | 1/1988 | Hormann |
| 4,723,588 | A | 2/1988 | Ruppel |
| 4,738,296 | A | 4/1988 | Hatch |
| 4,795,206 | A | 1/1989 | Adams |

(Continued)

OTHER PUBLICATIONS

Lakal Rolladensysteme, Lakel Profil AHS 75 brochure, 4 pages—undated prior art.

(Continued)

*Primary Examiner*—Blair M. Johnson
(74) *Attorney, Agent, or Firm*—Ice Miller LLP

(57) ABSTRACT

A rolling shutter and a slat for use in a rolling shutter are provided. The slat comprises an engaging track located at a first horizontal edge and a receptacle track located at a second horizontal edge. Illustratively, the engaging track has a hook-shaped profile and is disposed at an acute angle, and the receptacle track comprises a lip and a guard defining a space adapted to receive therein an engaging track of an adjacent slat.

2 Claims, 5 Drawing Sheets

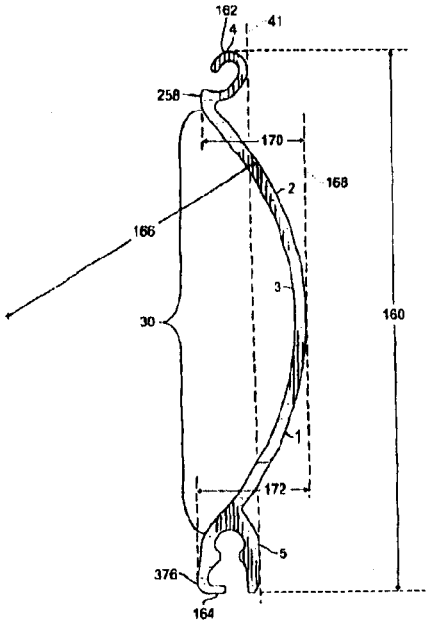

UNITED STATES PATENT AND TRADEMARK OFFICE

CERTIFICATE OF CORRECTION

PATENT NO. : 7,357,171 B2
APPLICATION NO. : 10/802385
DATED : April 15, 2008
INVENTOR(S) : James V. Miller It is certified that error appears in the above-identified patent and that said Letters Patent is hereby corrected as shown below:

Claim 1, column 10, line 1: Delete the phrase "for receiving an engaging track of an adjacent slat through an aperture thereof".

Claim 1, column 10, line 6: After the phrase --second edge of the body,-- insert the phrase --for receiving an engaging track of an adjacent slat through an aperture thereof--.

Signed and Sealed this

Tenth Day of August, 2010

David J. Kappos

David J. Kappos
*Director of the United States Patent and Trademark Office*